US006575456B2

(12) United States Patent
Müller

(10) Patent No.: US 6,575,456 B2
(45) Date of Patent: Jun. 10, 2003

(54) DEVICE FOR HELD CONVEYANCE OF FLAT ARTICLES IN A DENSE CONVEYING STREAM

(75) Inventor: Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/153,402

(22) Filed: May 22, 2002

(65) Prior Publication Data

US 2002/0175044 A1 Nov. 28, 2002

(30) Foreign Application Priority Data

May 25, 2001 (CH) ..... 0974/01

(51) Int. Cl.[7] ..... B65H 29/04

(52) U.S. Cl. ..... 271/204; 271/205; 271/206; 271/85; 198/377.03; 198/377.07

(58) Field of Search ..... 271/204, 205, 271/206, 82, 85; 198/377.03, 377.04, 377.05, 337.06, 337.07, 337.08, 337.09; 294/116

(56) References Cited

U.S. PATENT DOCUMENTS 4,211,320 A * 7/1980 Yautz et al. ..... 271/82
4,681,213 A * 7/1987 Winiasz ..... 271/206
5,350,167 A * 9/1994 Hansch ..... 271/82
5,425,837 A * 6/1995 Hansch ..... 271/204
5,653,432 A * 8/1997 Hansch ..... 271/82
5,918,543 A * 7/1999 Becker et al. ..... 271/204
6,003,854 A * 12/1999 Keller ..... 271/204
6,039,317 A * 3/2000 Kramer ..... 271/204
6,139,252 A * 10/2000 Honegger ..... 198/377.07
6,264,192 B1 * 7/2001 Siebenmann et al. ..... 271/205
6,488,278 B1 * 12/2002 Hansch ..... 271/204
2003/0001333 A1 * 1/2003 Honegger ..... 271/204

FOREIGN PATENT DOCUMENTS

DE 199 06 202 A1 9/1999
EP 0 557 679 A1 9/1993
EP 1 044 907 A2 10/2000

* cited by examiner

*Primary Examiner*—Donald P. Walsh
*Assistant Examiner*—Matthew Kohner
(74) *Attorney, Agent, or Firm*—Rankin, Hill, Porter & Clark LLP

(57) ABSTRACT

For conveying flat articles (10) in dense conveying streams, grippers (3) conveyed one behind the other by conveying elements (1) are used, each gripper (3) holding one of the articles gripped in an edge zone. For increasing the possibilities for changing the orientation of the flat articles (10) during such conveyance, the grippers (3) are attached to the conveying elements (1) by asymmetrically-projecting gripper arms (2) and the grippers (3) are designed to be rotated through 360° around the gripper arm axis. The device can be used universally, particularly for held conveyance of printed products and it is very easily adjustable for differing applications.

17 Claims, 7 Drawing Sheets

DEVICE FOR HELD CONVEYANCE OF FLAT ARTICLES IN A DENSE CONVEYING STREAM

BACKGROUND OF THE INVENTION

The present invention is situated in the field of materials handling technology and relates to a device for conveying individually held flat articles in a dense conveying stream wherein the articles are conveyed one after the other with distances between one another (measured in the conveying direction), which usually are smaller than the dimensions of the articles parallel to their flat extent.

Conveying streams of the type mentioned above are customary in the further processing of printed products, such as in the field of dispatch room technology. In such technologies the printed products delivered from a printing machine at different time periods are processed, for example, by being combined in groups, re-arranged and/or packaged, in a manner to be able to be readied for dispatch at an outlet station.

In dispatch room technology, the printed products are conveyed in imbricated streams, in which the products lie loose on a conveying surface partially overlapping one another or are pressed onto such a surface with suitable means. In such an imbricated stream the spacing between the products corresponds to the distance between the leading edges of each two successive products. Depending on the orientation of the products in the imbricated stream, the leading edges are oriented downwards or upwards and in the case of folded products the folded edge or the edge opposite the folded edge is the leading edge.

The orientation of the printed products in an imbricated stream can be changed, for example, by twisting or deflecting the imbricated stream such that, from a stream with leading edges lying on top, a stream with leading edges lying underneath can be formed. In doing so, the printed products are inverted (the top side is turned downwards). By reversing the conveying direction of an imbricated stream (winding up and unwinding again), the leading edges become the trailing edges, wherein the products maintain their position (the top side remains on top). However, the product sequence is inverted. For other re-arrangements, in most instances every product of an imbricated stream is individually gripped, is re-oriented and is then deposited in the stream once again. This, however, is a very elaborate operation in particular in respect to the equipment required.

Frequently used in dispatch room technology are also dense conveying streams of individually held printed products, i.e. conveying streams in which the printed products are conveyed one after the other, each one held by a gripper. The grippers are arranged one behind the other on transport elements movable along a conveying track, for example, arranged on the links of a conveyor chain, and each gripper grips and holds a flat article in an edge region, such as in the middle region of one edge. Usually, the grippers are arranged symmetrically with respect to the conveying track of the transport elements, i.e., there is a plane, in which the conveying track is situated and which cuts the grippers conveyed one behind the other into two functionally equivalent parts. In many instances, the grippers are swivelling parallel to the direction of conveyance either freely or in a controlled manner. The transport elements are usually moved in guide channels, which may have a curved course and if so required may be twisted.

Printed products being conveyed in a held manner can be arranged perpendicular to the conveying track (e.g., for horizontal conveyance, they are suspended vertically downwards from the grippers), so that, even if the distances between the products are smaller than the flat extent of the products, there is no overlapping and there are no leading and trailing edges. However, as soon as the products in the conveying stream are not arranged precisely perpendicular to the conveying direction, they overlap one another in a similar manner as in an imbricated stream and there are leading and trailing edges.

In a conveying stream, in which products are conveyed individually held by grippers, the products can be re-orientated in more ways and in a simpler manner than is the case in an imbricated stream. In particular, it is possible by simply displacing the edges opposite the held edges from a leading to a trailing position, to reverse the products (the leading edge becomes the trailing edge, the product top side becomes the bottom side).

SUMMARY OF THE INVENTION

It is an object of the invention to create a device for held conveyance of flat articles in a dense conveying stream, with which device even more re-orientations of the flat articles shall be possible during conveyance and in a more simplified manner than is possible with known devices serving the same purpose. Therefore, the device can be used universally in the most diverse applications. Nonetheless, the device will not be significantly more complicated and elaborate than known devices for held conveyance of flat articles.

In accordance with the present invention, the device includes a plurality of grippers for gripping and holding the flat articles in an edge region. The grippers are designed to be opened and closed in a controlled manner. Each gripper is arranged on a gripper arm, the gripper arm being arranged on a transport element from which it projects to one side. The transport elements are movable along a conveying track and they are connected together in a chain or they are independent of one another and they move along the conveying track driven by a suitable drive, for example, guided in a suitable guide channel. The grippers are designed to rotate without limitation around the gripper arm, i.e., in essence by 360°.

By rotating the grippers around the gripper arms during conveyance, flat articles held gripped by the grippers can be brought into the most diverse spatial positions relative to the conveying track of the transport elements. For changing their orientations, the flat articles can also be moved through between adjacent grippers. As shown further on, the articles can be brought into all possible orientations in the stream if, in addition to the unlimited gripper rotation, it is possible to arrange the conveying track to be deflected and/or twisted. Depending on the application, the rotational position of the grippers in one area can also be changed over time. Therewith it is easily possible to change the device according to the invention for receiving articles supplied with-various orientations and delivering them in always the same orientation.

For a re-orientation that necessitates a movement of the flat articles between adjacent grippers, the spacing between the grippers may need adjustment to the format and to the flexibility of the flat articles. If the grippers are arranged on individual transport elements being movable along the conveying track in a substantially independent manner, local enlargement of the spacings between the grippers is no problem at all.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
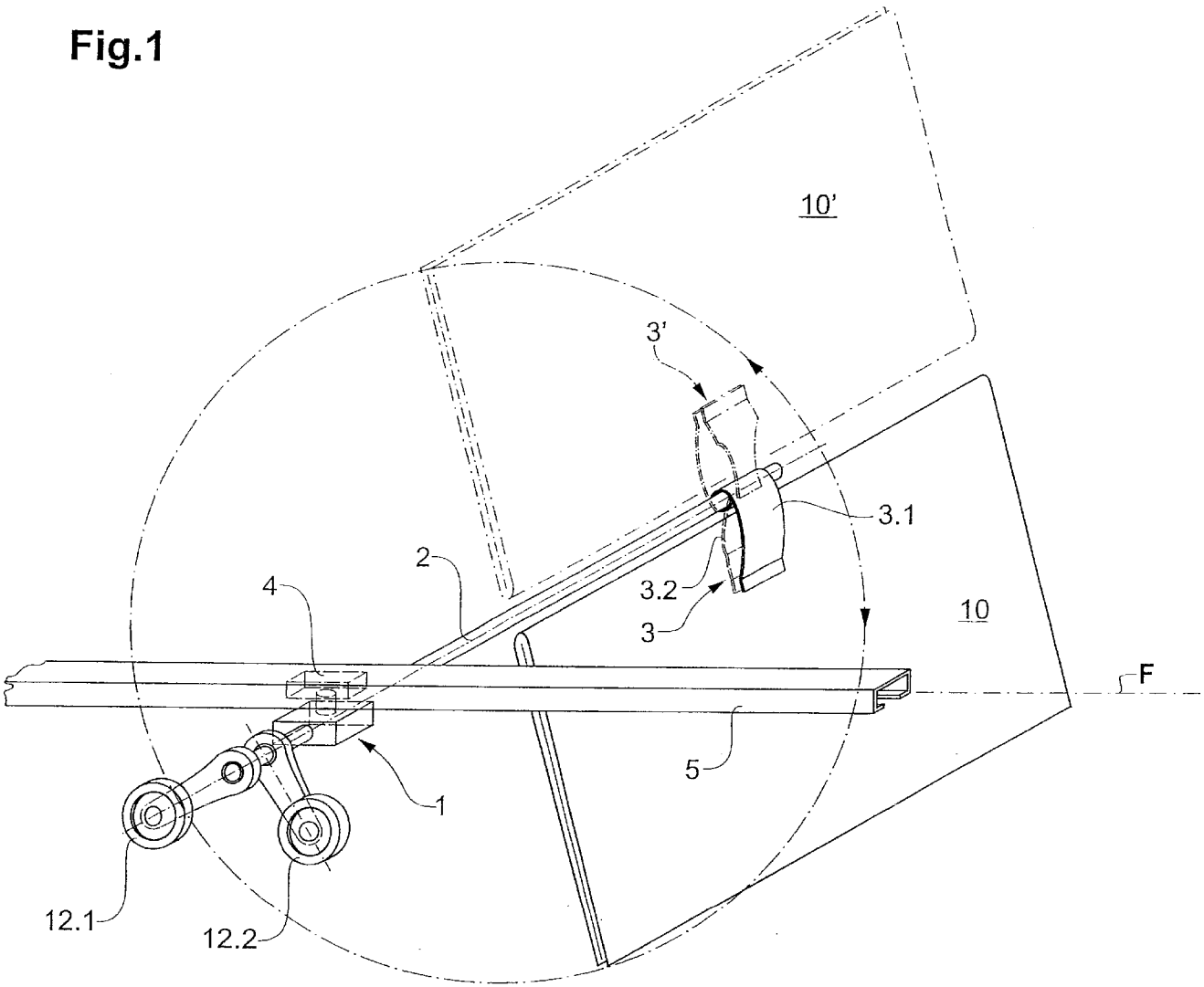
FIGS. 1 and 2 show an exemplary embodiment of the device according t the invention as a schematic, three-dimensional view (FIG. 1) and in a cross-section perpendicular to the conveying track (FIG. 2)
Figure 2:
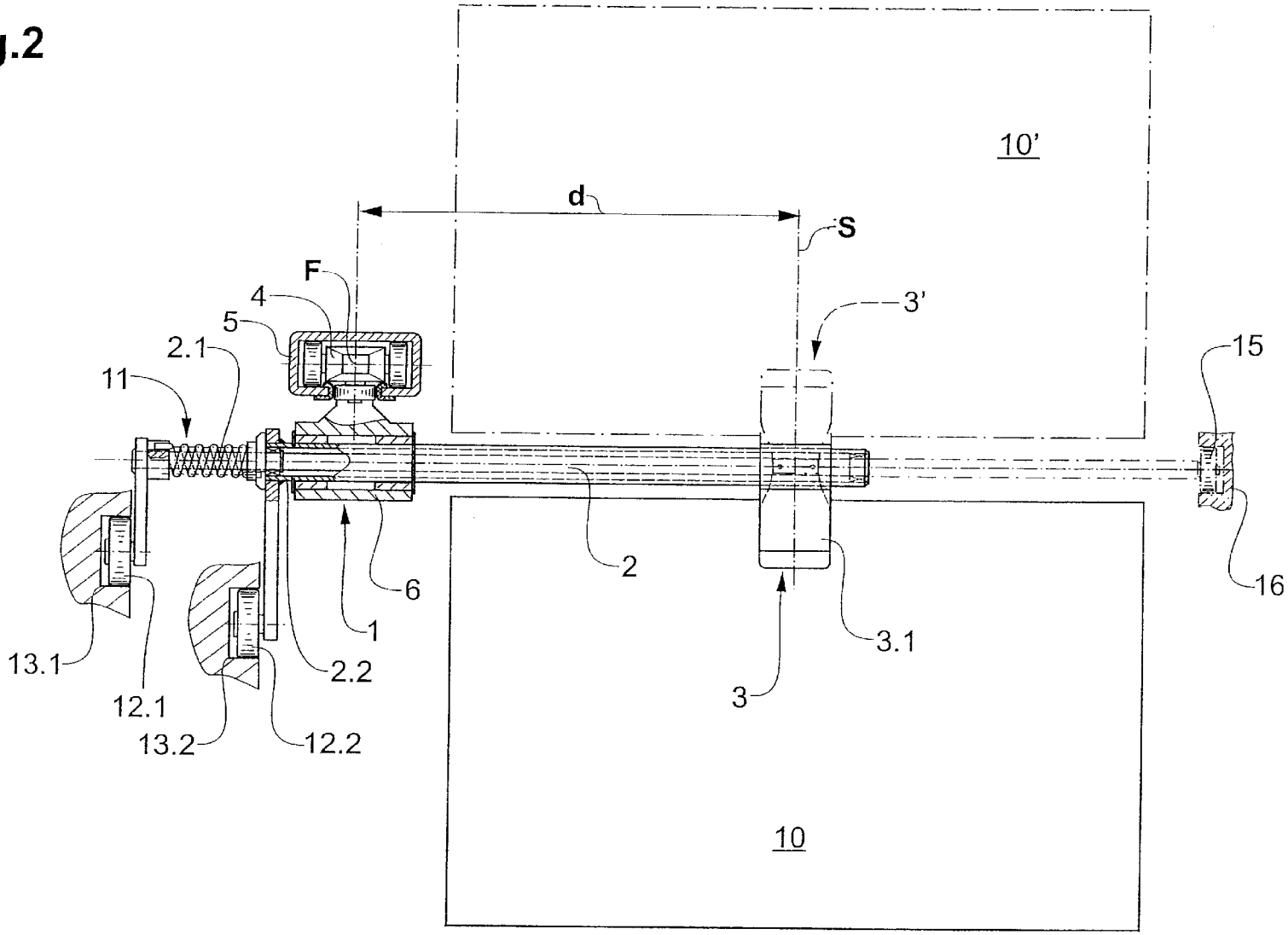

FIGS. 1 and 2 illustrate an exemplary embodiment of the device according to the invention showing a section of the conveying track F and a transport element 1 movable along the conveying track F. A gripper arm 2 is arranged on the transport element. One gripper or a plurality of grippers 3 is arranged on the gripper arm 2. FIG. 1 illustrates this as a schematic, three-dimensional view, FIG. 2 as a section transverse to the conveying track F.

The device comprises a multitude of advantageously identical transport elements 1, which are movable along the conveying track F being connected together in the manner of a chain with fixed and regular distances or with variable distances between one another or which are movable in a manner independent of one another. For moving the transport elements 1, a suitable drive (not illustrated) is provided. One part of the transport element 1 is designed as a roller part or sliding part 4 rolling or gliding along in a guide channel 5. The gripper arm 2, for example, is attached to a transport element part 6 projecting from the guide channel 5.

The gripper arm 2 with the gripper 3 is arranged on the transport element 1 in an asymmetrical manner such that the conveying track F is at a distance d from a symmetry plane S cutting the gripper 3 into two functionally equivalent halves (or a plurality of grippers into two equal parts). The distance or projection d is such that the flat articles 10 to be gripped and to be conveyed in a gripped manner do not come into contact with the guide channel 5. If the articles, as illustrated in the FIGS. 1 and 2, are to be gripped in the middle of one edge, then d is to be greater than half the length of the gripped edge.

The gripper 3 comprises, in a per se known manner, two gripper jaws 3.1 and 3.2 movable relative to one another. These jaws are, for example, driven towards each other into a closed position by a compression force and can be moved away from one another into an open position against the compression force.

For the gripper positioning, the gripper arm is installed in a bearing in the transport element 1 such that it can be rotated around its own axis substantially without limitation. For the gripper actuation, the gripper arm comprises two coaxial arm parts 2.1 and 2.2 capable of rotating relative to one another within limits, wherein on each of the arm parts 2.1 and 2.2 one of the gripper jaws 3.1 and 3.2 is attached such that the gripper 3 is able to be actuated (opened and closed) by relative rotation of the arm parts 2.1 and 2.2. For generating the compression force between the two gripper jaws 3.1 and 3.2, a pre-tensioned spring 11 is provided between the two gripper arm parts 2.1 and 2.2.

The gripper is controlled with respect to its rotational position and with respect to its opening condition, for taking over articles, during conveyance of the articles and for delivering the articles. In FIGS. 1 and 2, the gripper 3 is depicted only in its closed state and in two rotational positions differing from one another by 180° (positions 3 and 3' of the gripper or positions 10 and 10' of a flat article held by the gripper). For gripper control, for example, each arm part 2.1 and 2.2 carries one control roller 12.1 and 12.2 on the gripper arm side opposite the gripper. For guiding the control rollers, cams 13.1 and 13.2 are provided along at least part of the conveying track F, the control rollers 12.1 and 12.2 roll along the cams when the transport element 1 is conveyed along the conveying track F.

The control roller 12.2 is arranged on the outer arm part 2.2 and cam 13.2, along which the control roller 12.2 rolls, determines the rotational position of the gripper 3. In sections of the conveying path F, in which the rotational position of the grippers 3 is not relevant or in which the grippers are to be freely rotating, cam 13.2 can be omitted. The control roller 12.1 is arranged on the central arm part 2.1, which itself is connected with the outer arm part 2.2 through the pre-tensioned spring 11. Cam 13.1, along which the control roller 12.1 rolls, determines the opening condition of the gripper 3. In sections of the conveying track F, in which the grippers are to be constantly closed, the cam 13.1 can be omitted.

As is evident from FIG. 2, the free end of the gripper arm 2 may be extended such that it projects beyond a held flat article 10 on the side opposite the transport element 1. The gripper arm 2 may comprise a supporting roller 15 side, which rolls along or in a guide 16. Such an arrangement is advantageous in cases in which the grippers 3 have to hold large articles and the gripper arms 2 for this purpose have to project a long way, in cases in which the grippers 3 have to bear the full weight of the articles 10 and/or in cases in which very accurate positioning of the grippers 3 is necessary. In place of the supporting roller 15, it is also possible to provide a further transport element 1.

The fundamental characteristics of the transport element 1, gripper arm 2, gripper 3 and gripper control in accordance with the invention are clearly evident from FIGS. 1 and 2. For one skilled in the art it is very easily possible to modify the embodiments illustrated in these drawings in order to create further embodiments of the device according to the invention. In particular, the transport elements 1, the active connection between the two gripper jaws 3.1 and 3.2 and the gripper control means 12.1/12.2 and 13.1/13.2 can be designed in the most diverse ways being known by one skilled in the art. In particular, instead of the as such stationary cam 13.1 and 13.2, which act on all grippers conveyed past in the same manner, control means may also be provided, which, for example, for selective delivery of flat articles by the grippers, only act on selected ones of the grippers. Furthermore, it is possible to provide a plurality of grippers 3 on each gripper arm 2 and simultaneously actuating and rotating the grippers 3.

Figure 3:
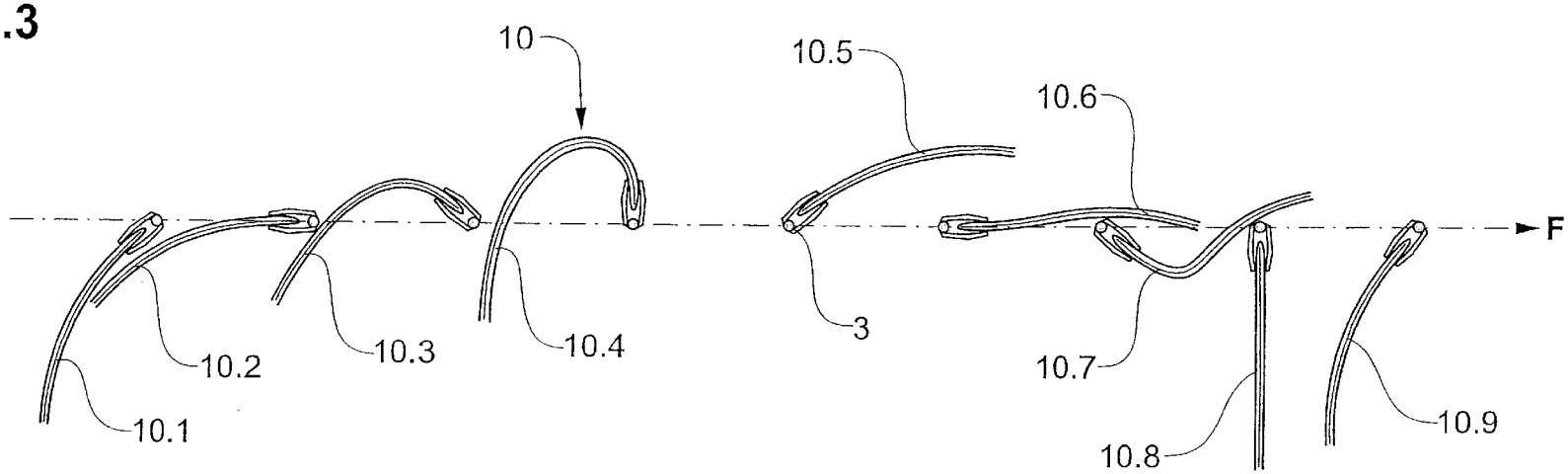
FIGS. 3 and 4 show the possible spatial positions of a flexible, flat article being conveyed by a device according to the invention.
Figure 4:
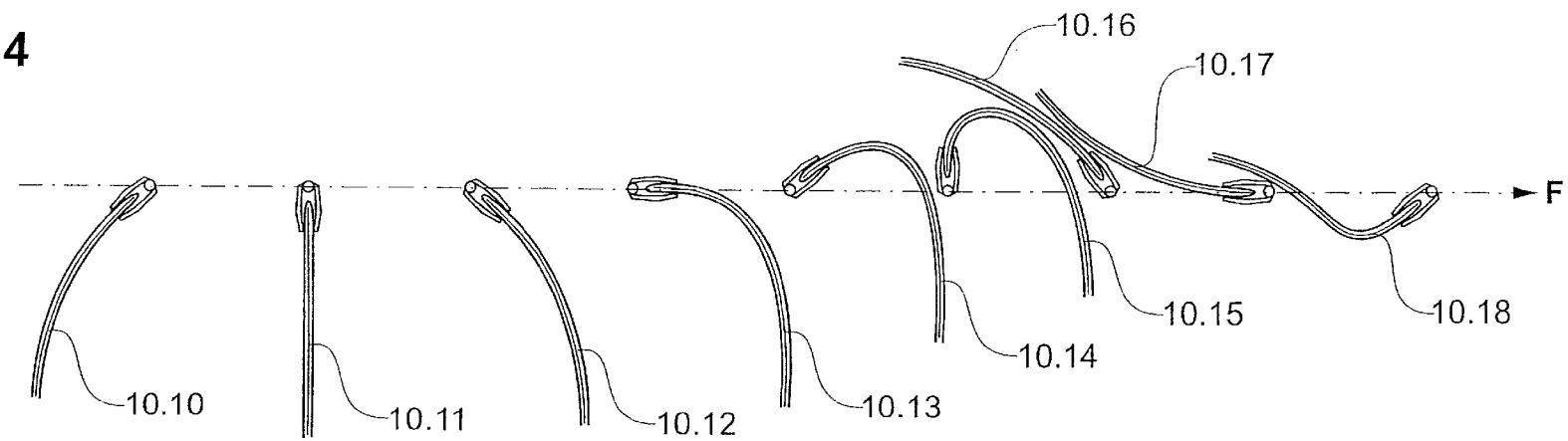

FIGS. 3 and 4 show in a very schematic manner and viewed transverse to the conveying track F, positions 10.1 to 10.18, which a flat object 10 conveyed by a device in accordance with the invention is able to assume (the flat articles are illustrated to be printed products held gripped at their folded edge), when the gripper 3, which holds the article 10, is rotated clockwise (FIG. 3) or counter-clockwise (FIG. 4) around the axis of the gripper arm (not depicted in FIGS. 3 and 4). To be noted in particular is the manner in which the article between positions 10.2 and 10.5, 10.6 and 10.8 as well as 10.17 and 10.18 is moved through between two adjacent grippers 3 from one side of the conveying track F to the other side. From FIGS. 3 and 4 it is also evident that such movement of the flat articles may call for an adjustment of the distances between the grippers to the size and to the flexibility of the flat articles 10.

FIGS. 3 and 4 can also be perceived as a hypothetical snapshot of a conveying stream in which the gripper positions are continually changed. If a gripper actuation is superimposed on this hypothesis, in the case of which the grippers are closed in a first position and are opened again in a second position downstream of the first position. It also becomes clear that with the help of the-device in accordance with the invention flat articles can be taken over from conveying streams with substantially any orientation of the articles and that, by delivering the flat articles by the device according to the invention, other conveying streams with substantially any orientation of the articles can be established. This is made even more clear by FIG. 5 (viewed transverse to the conveying tracks F and F'), which shows folded printed products held on their folded edge and having a front side (unbroken line) and a back side (broken line) and serving as examples of flat articles 10. The printed products are shown in sections A.1 to A.12 of conveying streams, in which these articles can be conveyed with the help of a device according to the invention.

Every one of the sections A.1 to A.12, which is illustrated on the conveying track F, or F' respectively, can be established starting from another section depicted on the same conveying track F or F' respectively by simple rotation of the grippers. Every section A.7 to A.12 illustrated on the conveying track F' can be established from a section A.1 to A.6 illustrated on the conveying track F (and vice-versa) by twisting the conveying track or by a deflection of the conveying track in combination with a gripper rotation. Each one of the illustrated conveying stream sections A.1 to A.12 can depict a just picked up conveying stream, i.e. a conveying stream not yet changed after taking over or a conveying stream ready for delivery. Obviously, all possible conveying streams (front side on top or underneath, folded edge leading or trailing, leading edge on top or underneath) can be taken over and established using the device in accordance with the invention with corresponding gripper positioning and synchronisation between gripper conveyance and supply stream. The same is applicable for conveying streams in which the flat articles are oriented exactly transverse to the direction of conveyance (front side in front or behind, folded edge on the bottom or on the top).

Figure 5:
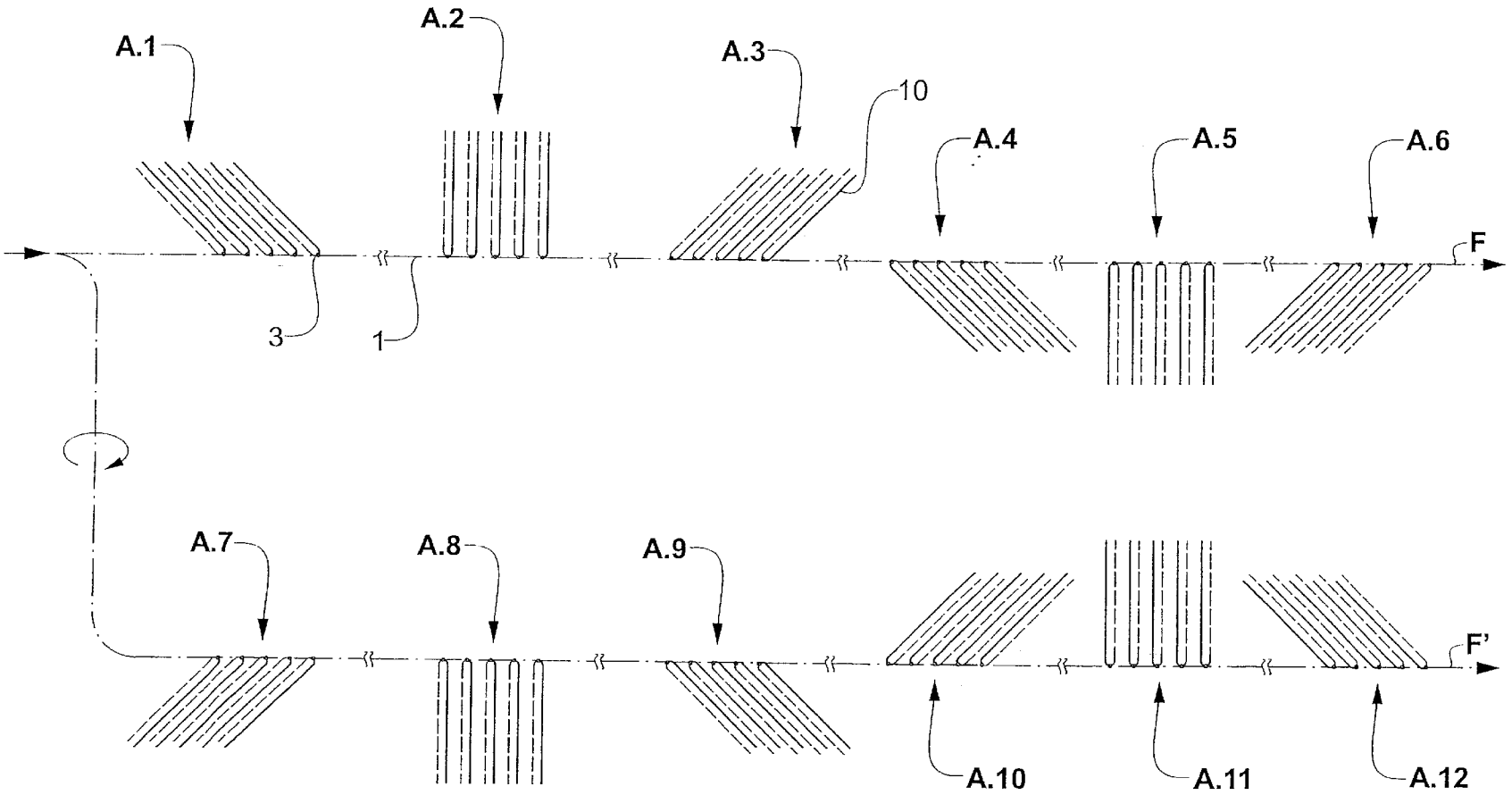
FIG. 5 shows conveying streams of flat articles with different object orientations, which streams can all be taken over or can be established and delivered using a device in accordance with the invention.

FIGS. 6 to 9 show still schematically but in somewhat more detail than FIGS. 3 to 5 applications of the device according to the invention, particularly take-over and handing-over of flat articles 10 by the device in accordance with the invention.

Figure 6:
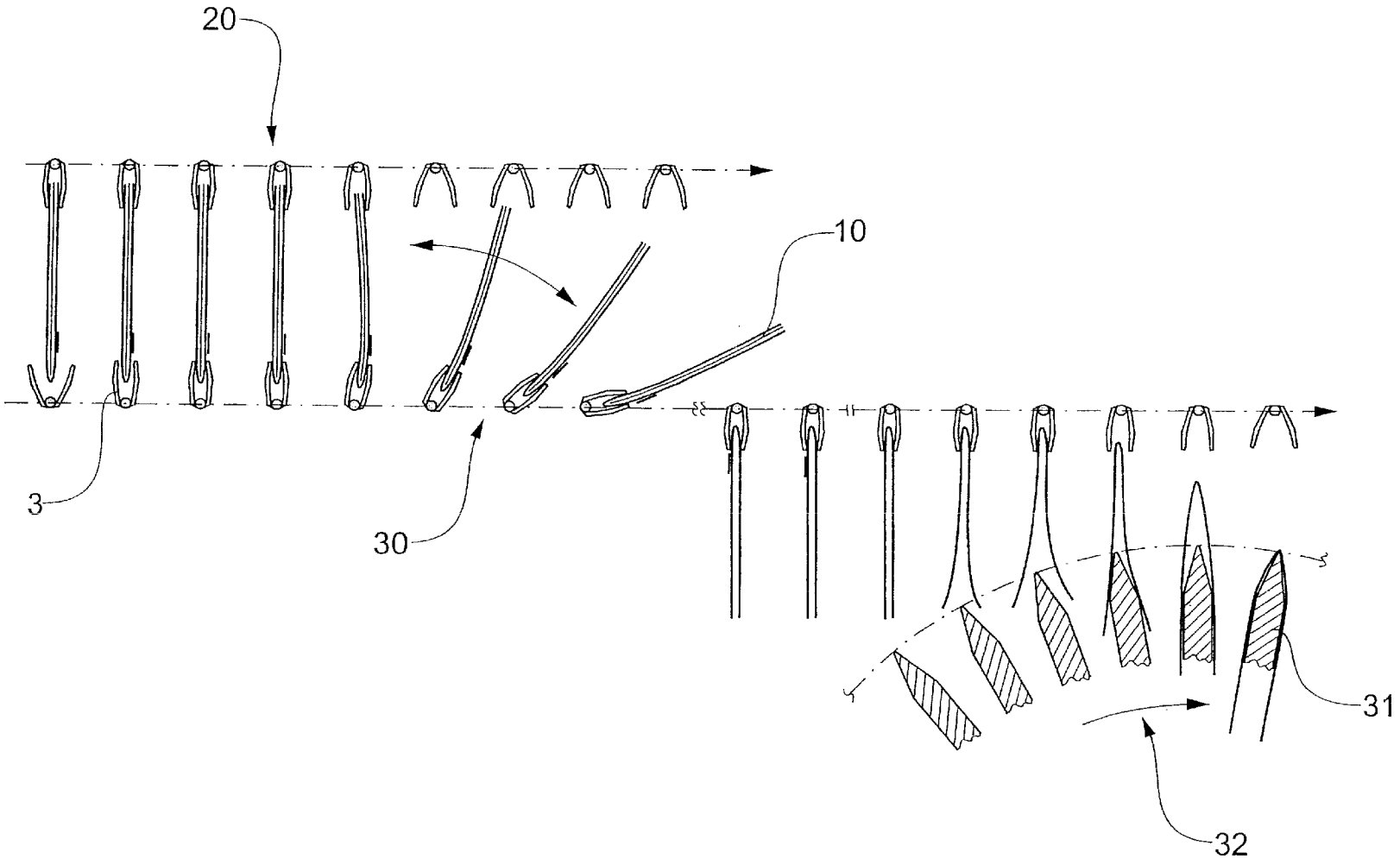
FIG. 6 shows an exemplary application of the device according to the invention (viewed perpendicular to the conveying direction)

FIG. 6 illustrates a stream transformation by a device in accordance with the invention. With an as such known conveying device 20, folded printed products (flat articles 10) are supplied, being held gripped and suspended at their edges opposite the folded edges and are taken over by grippers 3 of a device according to the invention 30. The conveying stream being taken over corresponds with respect to the article orientation to section A 2 or A 11 of FIG. 5. After the take-over of the printed products, the grippers 3 are rotated such that the printed products are brought into a suspended position (section A.5 or A.8 of FIG. 5) in which the edges opposite the folded edges are positioned on the bottom. The articles are opened with suitable means (not illustrated) and, for example, deposited on to saddle-shaped supports 31 of a collecting drum 32.

From FIG. 6 it is clearly evident, how easily the illustrated stream transformation can be implemented using the device according to the invention.

Figure 7:
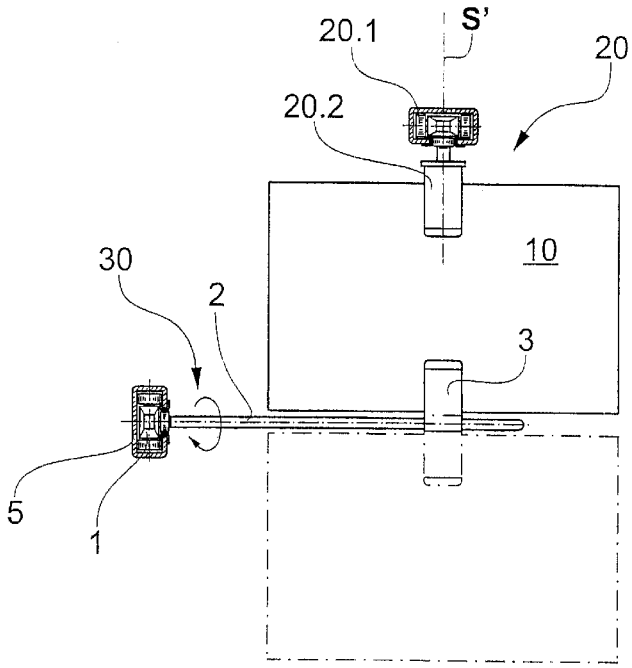
FIG. 7 shows, in the application according to FIG. 6, taking-over of flat articles by the device according to the invention and re-orientation of the flat articles (viewed parallel to the conveying direction)

FIG. 7 illustrates, viewed parallel to the conveying track F, the take-over of the articles by the device 30 according to the invention from the conveying device 20, which take-over is viewed transverse to the conveying track F in FIG. 6. Conveying device 20 comprises transport elements 20.1 with grippers 20.2 and with roller or sliding parts rolling or sliding in a conveying channel. In this case, however, the conveying track of the transport elements 20.1 lies in the one plane S' separating the grippers 20.2 into two functionally equivalent parts. In the case of the device according to the invention this does not apply (refer to FIG. 2 and the corresponding parts of the specification).

FIG. 8 illustrates, viewed again transverse to the conveying track F, a further possible handing-over or delivery of flat articles 10 (folded printed products) by a device in accordance with the invention 30, the articles to be delivered having been, for example, taken over as shown in FIG. 6. With their held edges leading, the articles are deposited on L-shaped supports 40, for example, for producing stacks. Thanks to the projection of the gripper arms relative to the conveying elements and relative to the guide channel, which guides the movement of the conveying elements, meshing of grippers and supports necessary for such deposition is easily possible. It goes without saying that the handing-over illustrated in FIG. 8 can be preceded by a different type of taking-over than the taking-over depicted in FIG. 6, which then, if so required, calls for a re-orientation of the products 10 prior to the handing-over being implemented by gripper rotation.

Figure 8:
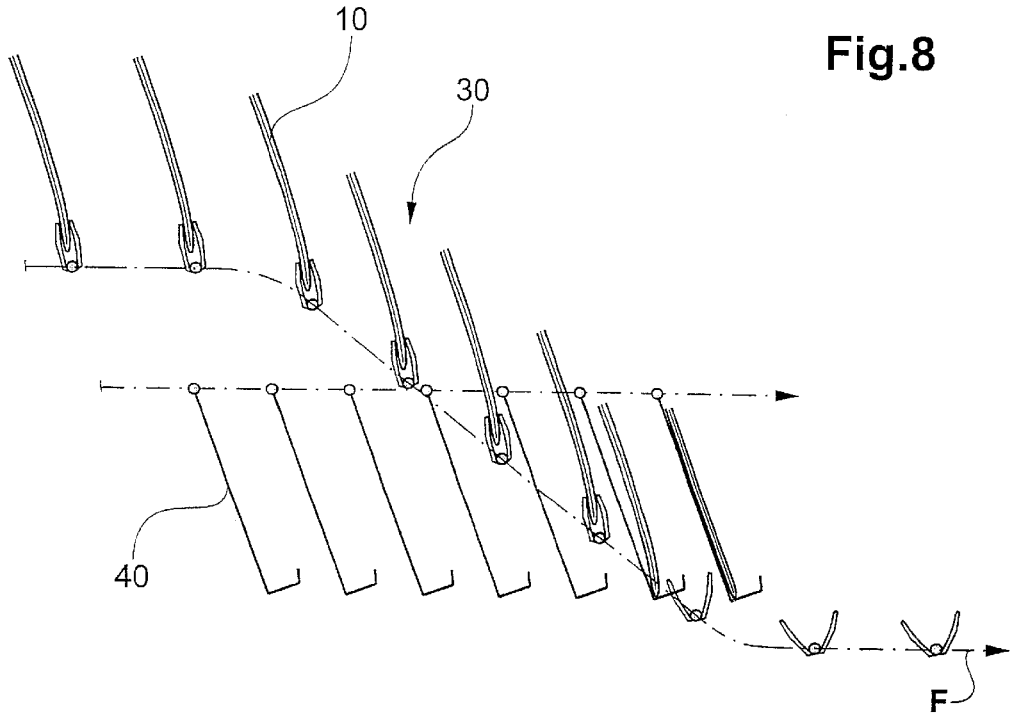
FIGS. 8 and 9 show further applications of the device according to the invention.

In the same manner as illustrated in FIG. 8 for the grippers of a device according to the invention and L-shaped supports of a further device, it is possible also for grippers of two devices in accordance with the invention to pass through one another in a comb like or meshing manner. Furthermore, it is possible for grippers of two devices according to the invention to be conveyed alternately in a common conveying stream, wherein the two conveying devices are arranged on opposite sides of the conveying stream and the gripper arms of the two devices are arranged as projecting towards the conveying stream from opposite sides. Printed products conveyed in a common conveying stream of this kind can have alternatingly different orientations and, therefore, for example, are capable of being directly stacked in cross stacks.

Figure 9:
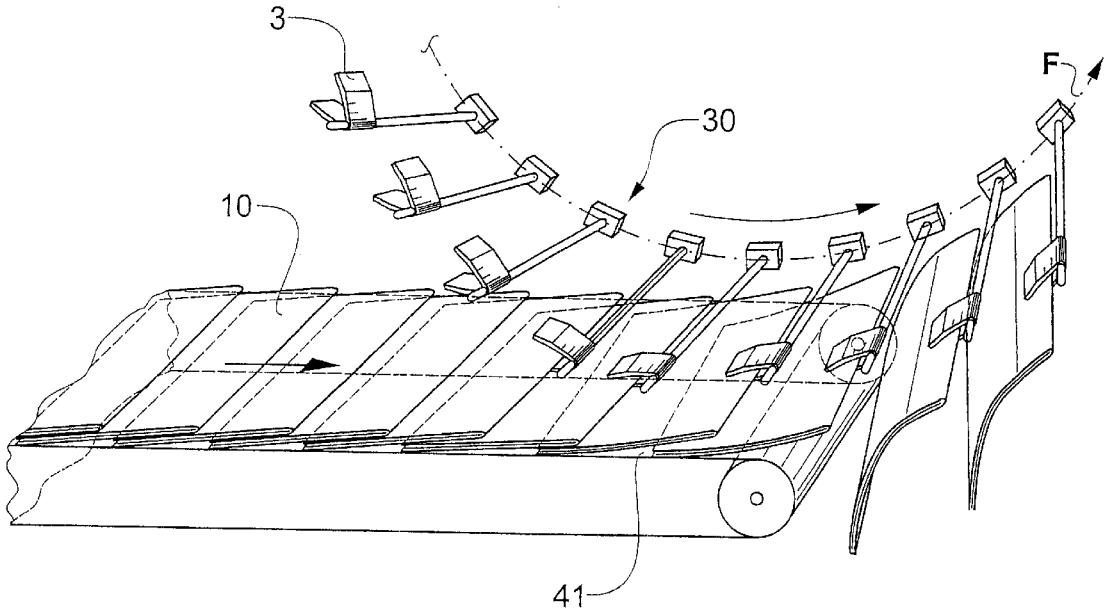

FIG. 9 depicts a further example of a take-over of flat articles by a device 30 in accordance with the invention. The supplied stream of flat articles 10 is an imbricated stream of folded printed products with folded edges leading and lying on top of the stream, which, for example, is supplied on a conveyor belt 41 from a rotation. The grippers 3 of the device according to the invention 30 approach the imbricated stream from above and, in the take-over zone, have a lower speed than the conveyor belt 41 so that the printed products or their folded edges respectively are pushed into grippers 3 for being taken over. Thereupon, the grippers 3 are closed.

It is clearly evident from FIG. 9 that an imbricated stream (for example, from a coil), in which the folded edges of the printed products are lying on top in the conveying stream, but are trailing, can also be taken over by the device in accordance with the invention. For such take-over, the grippers are solely rotated by about 180° relative to the gripper position of FIG. 8, so that the gripper mouths are directed forwards in conveying direction, and the supply speed is adjusted such that the grippers catch up with the products from behind and thereby slide over the folded edges. The device according to the invention 30 and the supply device 41 as illustrated in FIG. 9 can therefore be adapted to selective use for taking-over printed products with leading or with trailing folded edges lying on top by a very simple conversion, wherein the products independent of the manner of their supply can be brought into a predefined handing-over position. Necessary for the conversion is, in essence, a displacement of the cam controlling the gripper position in the take-over zone.

Figure 10:
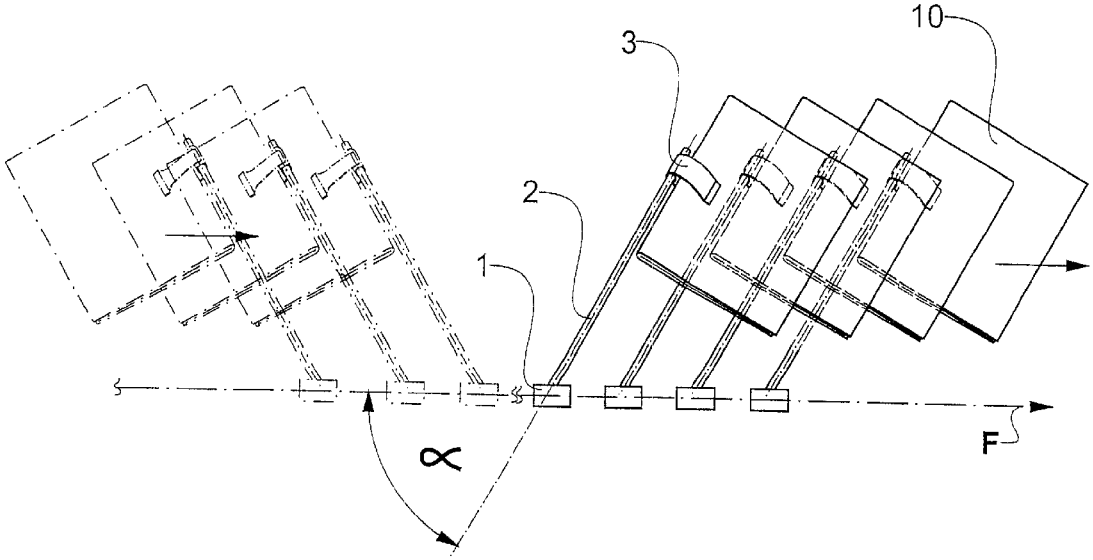
FIG. 10 shows a further embodiment of the device according to the invention.

FIG. 10 illustrates a further embodiment of the device according to the invention, which is suitable in particular for taking-over or for establishing imbricated streams, in which the flat articles 10 are arranged without edges aligned transverse to the conveying track F. For this purpose, the gripper arms 2, in contrast to the depiction in the preceding drawing figures, are not arranged as projecting transverse to the conveying track F, but rather projecting at an angle $\alpha$. This angle $\alpha$, for example, may be 60°, 45°, 120° or 135°.

What is claimed is:

1. A device for held conveyance of flat articles (10) in a dense conveying stream, the device comprising:

a plurality of grippers (3), each gripper being equipped for controlled taking-over, holding and releasing an edge zone of one flat article (10) and each gripper being conveyed with the help of a conveying element (1), the conveying elements being displaceable along a conveying track (F) one behind the other, wherein each one of the grippers (3) is arranged on a gripper arm (2), the gripper arm (2) with the gripper (3) are arranged on the conveying element (1) and project asymmetrically therefrom such that the conveying track (F) of the conveying elements (1) is spaced from a symmetry plane (S) separating the gripper (3) into two functionally equivalent parts, and wherein the grippers (3) are adapted for controlled rotation by 360° around a gripper arm axis.

2. The device according to claim 1, wherein the gripper arm (2) forms an angle with the conveying track (F), said angle being selected from the group consisting of 45°, 60° and 90°.

3. The device according to claim 1, wherein the gripper (3) comprises two gripper jaws (3.1 and 3.2), the gripper arm (2) comprises two coaxially arranged gripper arm parts (2.1 and 2.2), each one of the gripper jaws (3.1, 3.2) is attached to one of the gripper arm parts (2.1, 2.2) and wherein the two gripper arm parts (2.1 and 2.2) are arranged to be rotated without limitation relative to the conveying element (1) and to be rotated relative to one another with limitations.

4. The device according to claim 3, wherein the two gripper arms parts (2.1 and 2.2) are pre-tensioned relative to one another such that the gripper jaws (3.1 and 3.2) arranged thereon are pressed against one another by the pre-tensioning force.

5. The device according to claim 4, further comprising a spring (11) for pre-tensioning of the two gripper arm parts (2.1 and 2.2).

6. The device according to claim 3, wherein, for controlled gripper actuation and for controlling the rotational position of the grippers (3) relative to the gripper arms (2), control means are provided on the two gripper arm parts (2.1 and 2.2).

7. The device according to claim 6, wherein the control means are control rollers (12.1 and 12.2) rolling along cams (13.1 and 13.2).

8. The device according to claim 1, wherein control means are arranged along the conveying track (F) such that, in at least one first location of the conveying track (F), the grippers (3) are closed for taking over articles (10) and, at a second location downstream of the first location, the grippers (3) are opened for handing over the articles (10) and, at a third location between the first and second locations, the rotational position of the grippers is changed.

9. The device according to claim 8, wherein, depending on the application, the control means are changed at at least one of the first, second and third locations.

10. Use of the device according to claim 9 for selectively taking over articles (10) from imbricated streams with different article orientations.

11. The device according to claim 8, wherein, in the third location, the control means are designed such that the grippers (3) are moved from one side of a gripper conveying track to the other side of the gripper conveying track.

12. The device according to claim 11, wherein, in the third location of the conveying track (F), means for enlarging the distances between the grippers are provided.

13. The device according to claim 1, wherein the conveying elements (1) are arranged to slide or roll in a conveying channel.

14. The device according to claim 13, wherein the conveying elements (1) are independent of one another.

15. Use of the device according to claim 1 for transforming a dense conveying stream of printed products with respect to the orientation of the printed products in the conveying stream.

16. Use of two devices according to claim 1 for establishing conveying streams, in which articles (10) with alternating article orientations are conveyed.

17. Use of a device according to claim 1 for transferring articles (10) to L-shaped supports (40) in a combing manner.

* * * * *

UNITED STATES PATENT AND TRADEMARK OFFICE

CERTIFICATE OF CORRECTION

PATENT NO. : 6,575,456 B2
DATED : June 10, 2003
INVENTOR(S) : Muller

It is certified that error appears in the above-identified patent and that said Letters Patent is hereby corrected as shown below:

Column 2,
Line 52, delete “with-various” and insert -- with various --.

Column 3,
Line 2, delete “t” and insert -- to --.

Column 4,
Line 39, after “15” insert -- on this --.

Signed and Sealed this

Twenty-third Day of September, 2003

JAMES E. ROGAN
*Director of the United States Patent and Trademark Office*